US006004143A

United States Patent [19]

Konno et al.

[11] Patent Number: 6,004,143

[45] Date of Patent: Dec. 21, 1999

[54] MOUNTING STRUCTURE OF I/O CONNECTOR IN MAGNETIC DISK DRIVE

[75] Inventors: Makoto Konno; Hisashi Shibata, both of Yamagata, Japan

[73] Assignee: Mitsumi Electric Co., Ltd., Tokyo, Japan

[21] Appl. No.: 09/025,445

[22] Filed: Feb. 17, 1998

[30] Foreign Application Priority Data

Feb. 18, 1997 [JP] Japan ..... 9-033887

[51] Int. Cl.[6] ..... H01R 9/09

[52] U.S. Cl. ..... 439/76.1; 361/752

[58] Field of Search ..... 439/76.1, 946; 361/752, 737, 802

[56] References Cited

U.S. PATENT DOCUMENTS 5,168,428 12/1992 Suzuki ..... 439/76.1

5,563,770 10/1996 Bethurum ..... 439/737

*Primary Examiner*—Khiem Nguyen
*Assistant Examiner*—T C Patel
*Attorney, Agent, or Firm*—Whitham, Curtis & Whitham

[57] ABSTRACT

A mounting structure for an I/O (input/output) connector in a magnetic disk drive comprises a frame of the magnetic disk drive including a side wall, an I/O connector mounted on a printed board, and an engagement piece formed within the side wall that obliquely extends downwards and toward the inside of the side wall. The engagement piece is pushed towards the sidewall by side faces of the I/O connector and the printed board facing the inner face of the side wall when the printed board, on which the I/O connector is mounted, is inserted into the frame of the magnetic disk drive. A tip end of the engagement piece contacts a top face of the I/O connector when the printed board, on which the mounted board is mounted, is completely mounted onto the frame of the magnetic disk drive.

5 Claims, 3 Drawing Sheets

FIG. 3 (a) Prior art
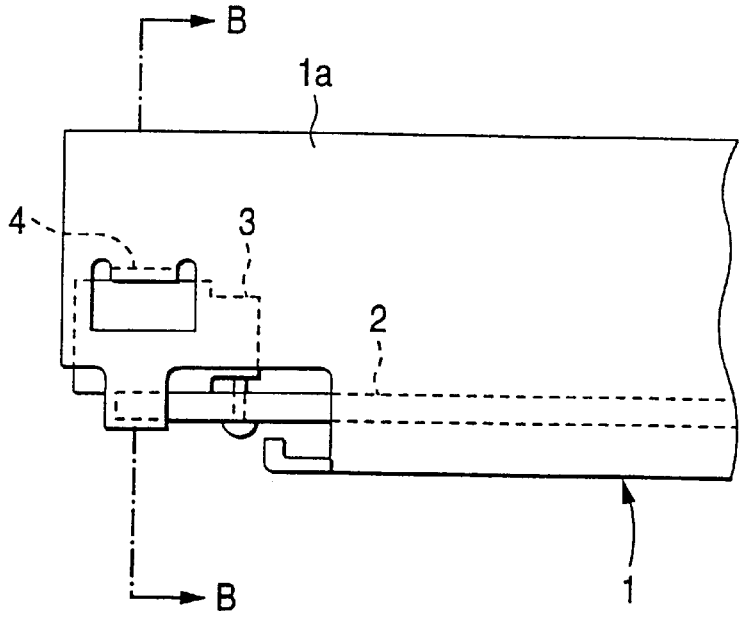
FIG. 3 (b) Prior art
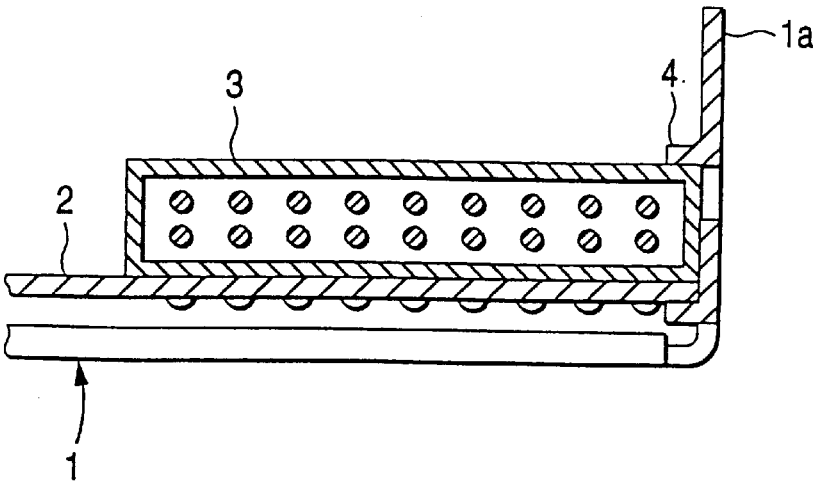

MOUNTING STRUCTURE OF I/O CONNECTOR IN MAGNETIC DISK DRIVE

BACKGROUND OF THE INVENTION

1. Technical Field of the Invention

The present invention relates to mounting structure of an I/O (input/output) connector for connecting with a main computer in a magnetic disk drive which is recording and reading data. Specifically, a structure in which vertical movement of the I/O connector and a printed board caused by insertion or removal of a main computer-side connector is restricted by a engagement piece formed with a side wall of a frame of the magnetic disk drive.

2. Background of Related Art

Descriptions for conventional mounting structure will be given below with reference to FIG. 3. In the figure, reference numeral 1 is a frame of a magnetic disk drive. A printed board 2 lies upon the frame 1, and an I/O connector 3 is mounted on the printed board 2 along the outer edge thereof.

On a side wall 1*a* of the frame 1, engagement piece 4 is provided by cutting in a part of the side wall 1*a* of frame 1 and bending the cut part up to the inside of side wall at a right angle. Engagement piece 4 contacts a top face of the I/O connector 3. Thereby, upward movement of the I/O connector 3 and the printed board 2 due to insertion or removal of a main computer-side connector is restricted.

To mount printed board 2, on which I/O connector 3 is mounted, onto frame 1, engagement piece 4, that is, the side wall 1*a* of frame 1, must be spread out in order to insert the printed board 2 and the I/O connector 3 from upward of the frame 1. Therefore, not only it is hard to assemble them but also there is a fear that the side wall 1*a* is deformed plastically.

SUMMARY OF THE INVENTION

The object of the present invention is to provide a mounting structure of an I/O connector in a magnetic disk drive which can restrict vertical movements of a printed board on which the I/O connector is mounted. Another object of the present invention is to facilitate assembly of the mounting structure.

To achieve the above object, there is provided a mounting structure of I/O connector that comprises a frame of the magnetic disk drive including a side wall, an I/O connector mounted on a printed board, and an engagement piece provided obliquely and extending downward on the inside of the side wall. The engagement piece is pushed towards the side by side faces of the I/O connector and the printed board facing inner face of the side wall when the printed board, on which the I/O connector is mounted, is inserted into the frame of magnetic disk. A tip end of the engagement piece contacts a top face of the I/O connector when the printed board, on which the mounted board is mounted, is completely mounted onto the frame of magnetic disk drive.

BRIEF DESCRIPTION OF THE DRAWINGS

In the accompanying drawings:

FIG. 2(*b*) is a section view taken along a line A—A shown in FIG. 2(*a*);

FIG. 3(*a*) is a side view of a conventional structure; and

FIG. 3(*b*) is a section view taken along a line B—B shown in FIG. 3(*a*).

DETAILED DESCRIPTION OF THE EMBODIMENT

Figure 1:
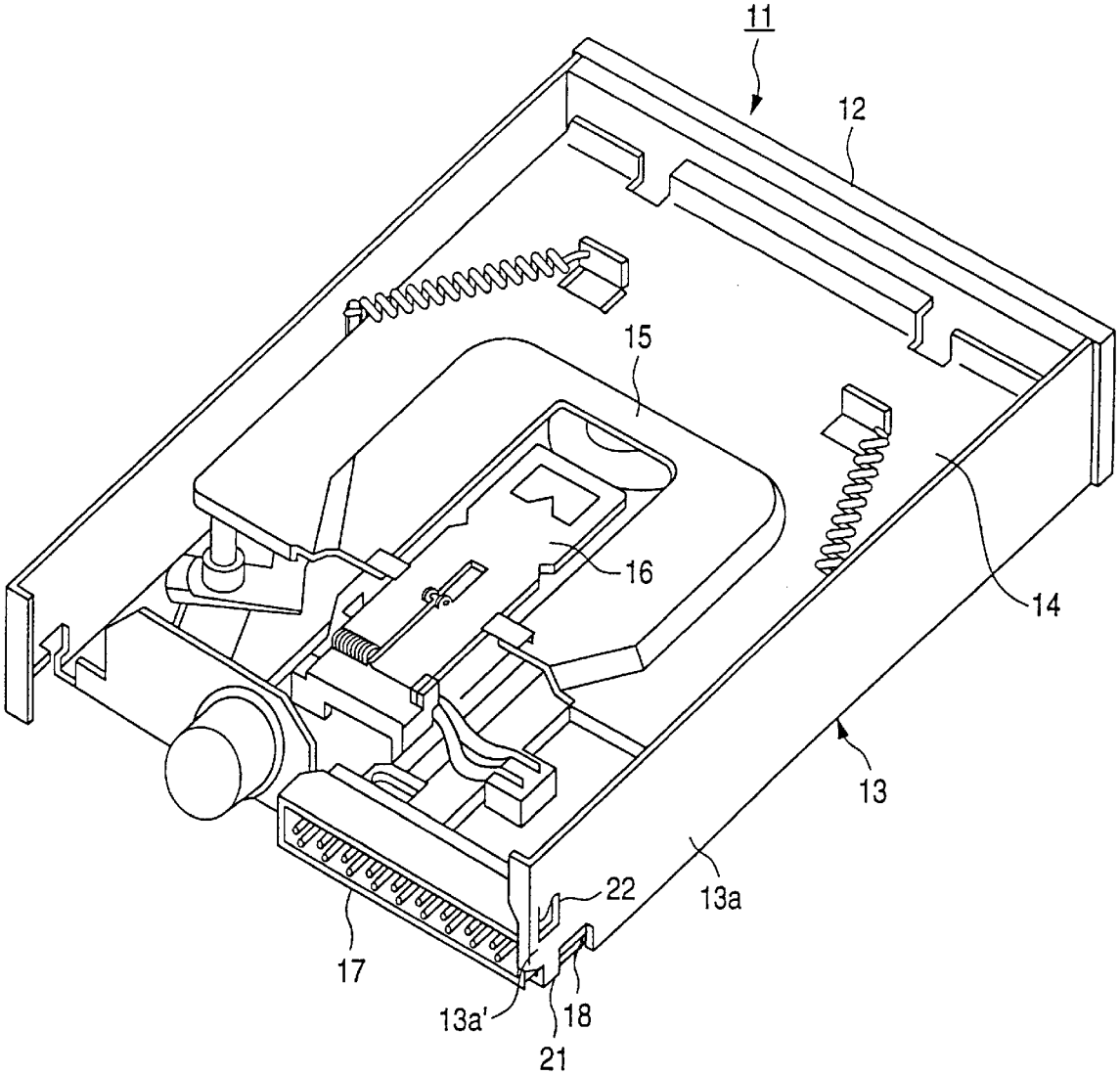
FIG. 1 is a perspective view of inner structure of a magnetic disk drive showing one embodiment of the present invention.

Now, descriptions will be given below in detail of one embodiment according to the present invention with reference to FIGS. 1 and 2. FIG. 1 shows inner structure of a magnetic disk drive 11. Here, a magnetic disk (not shown) is horizontally inserted from a front bezel 12 of the magnetic disk drive 11 and set between a lower frame 13 and an upper frame 14. Then the magnetic disk is chucked and rotated at a chucking/driving member 15 disposed in a front portion of the magnetic disk drive 11, and magnetic information is recorded or reproduced at a head member 16 disposed in a rear portion of the magnetic disk drive 11.

At the rear-right edge of the magnetic disk drive 11, a rectangular parallelepiped I/O connector 17 is mounted. Connecting the I/O connector with a main computer-side connector (not shown), instruction signals and information to be recorded are input from the main computer into the disk drive 11.

Figure 2:
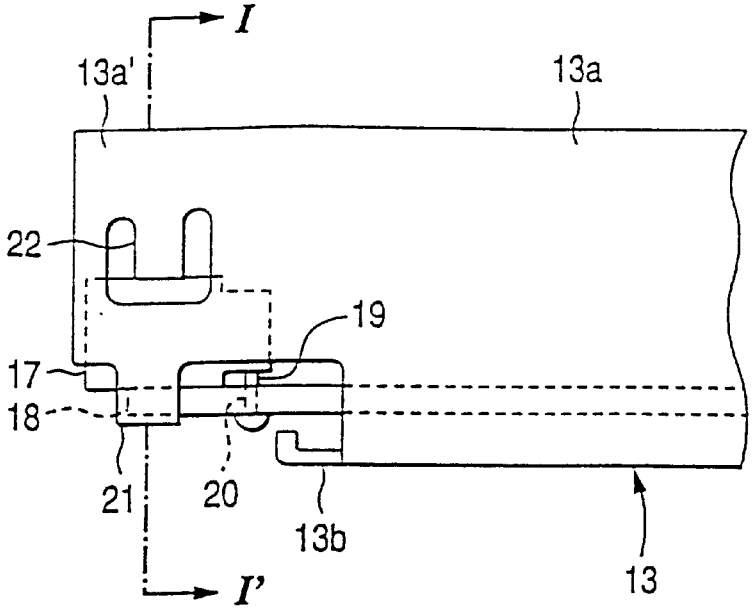
FIG. 2(*a*) is a side view showing the rear portion of the right side face of the magnetic disk drive.
Figure 2:
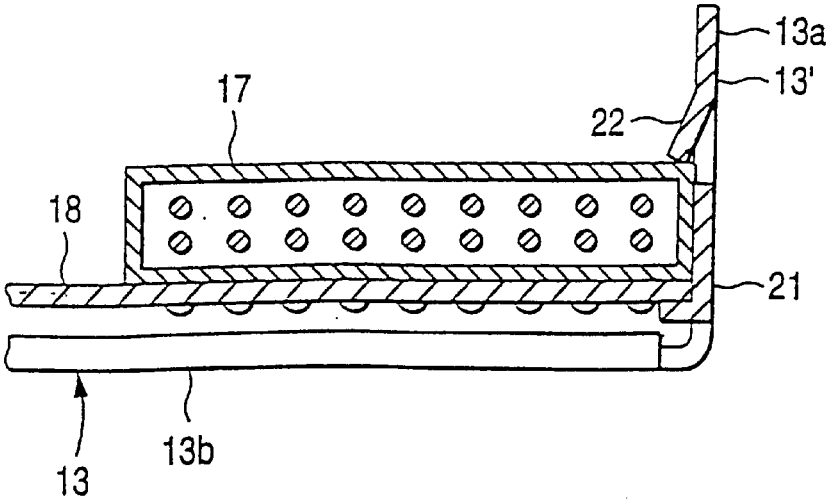

As shown in FIG. 2, the I/O connector 17 is mounted on a printed board 18 along an outer edge thereof (in FIG. 2(*a*), left end edge). Pins 19 hangingly provided on the back face of the I/O connector 17 are inserted into through holes 20 on the printed board 18. Tip ends of the pins 19 that protrude from a lower face of the printed board 18 are soldered. A side wall 13*a* of the frame 13 extends rearwards (in FIG. 2(*a*), leftwards) more than bottom plate 13*b* of the frame 13, and a L-shaped projection for supporting the printed board 18 is thus provided on a lower edge of the extended portion 13*a'*.

Further, in a rear-center portion of the extended portion 13*a*', engagement piece 22 is erectly provided so as to extend obliquely towards the inside of the extended portion 13*a*'. The engagement piece 22 is used to restrict vertical movement of the I/O connector 17 and the printed board 18 caused by insertion or removal of the main computer-side connector. The engagement piece 22 is formed at the same time as the lower frame 13 is formed by press molding. In more detail, when the lower frame 13 is formed from a steel plate by press molding, a predetermined portion is punched out in U-shape, then a piece left in the center of the punched portion is bent obliquely to the inside of side wall 13*a*.

After that, inserting the printed board 18, on which the I/O connector 17 is mounted, into the lower frame 13 from the top of rear-right end of the lower frame 13 along inner face of the side wall 13*a*, the right end faces (in FIG. 2(*a*), this side) of the I/O connector and the printed board 18 contact the engagement piece 22 and push it outwards. Hence, it is not necessary to spread out the extended portion 13*a*' of side wall 13*a* compulsorily when the printed board 18 is inserted. In this manner, the printed board on which the I/O connector 17 is mounted can be easily mounted upon the lower frame 13.

Then, when the printed board 18 is contact with the L-shaped projection 21 and thereby supported from a bottom portion thereof, the engagement piece 22 is released from upper end of the right face of I/O connector 17 and returns to the initial inclined state. At this time, a tip end of the engagement piece 22 causatively contacts right end of the top face of I/O connector 17. Vertical movement of the I/O connector 17 and the printed board 18, caused by insertion or removal of the main computer-side of connector, is securely restricted.

Also, according to the present invention, various changes and modifications are possible without departing from the scope and spirit of the invention, and of course, the present invention can cover such changes and modifications.

As has been described heretofore, according to the present invention, if the printed board on which the I/O connector is mounted is inserted into the frame, the engagement piece is automatically spread out by the I/O connector and the printed board. Thus it is not necessary to spread out the side wall compulsorily while inserting the printed board on which the I/O connector is mounted. Therefore, not only the mounting operation can be eased but also there is no fear that the side wall is deformed plastically.

Furthermore, when the printed board is completely set within the frame, the engagement piece is released from the end face of the I/O connector, and contacts with one side end of the top face of the I/O connector, thereby restricting the vertical movement of the I/O connector and the printed board.

What is claimed is:

1. A mounting structure for an I/O connector in a magnetic disk drive comprising:

magnetic disk drive including a frame side wall;

an I/O connector mounted on a printed board, the I/O connector having a top and bottom surface, and opposing side walls positioned between the top and bottom surfaces, wherein the I/O connector side walls are substantially parallel to the frame side wall; and a flexible engagement piece extending obliquely from the frame side wall towards the I/O connector side walls, the flexible engagement piece further extending downwards, the flexible engagement piece is pushed toward the frame side wall by one of the side walls of the I/O connector which face the frame side wall when the printed board is inserted into the frame of the magnetic disk drive, and a tip end of the flexible engagement piece contacting the top surface of the I/O connector when the printed board is completely mounted onto the frame of the magnetic disk drive.

2. The mounting structure of claim 1, further comprising:

an L-shaped projection formed at a lower portion of the frame side wall, the L-shaped projection being bent towards the inside portion of the frame, so that a portion of a bottom surface of the printed board is supported by the L-shaped projection when the printed board is completely mounted onto the frame of the magnetic disk drive.

3. The mounting structure of claim 1, wherein the tip end of the flexible engagement piece contacts an end portion of the top surface of the I/O connector.

4. The mounting structure of claim 1, wherein the side wall has a U-shaped cut about the engagement piece.

5. The mounting structure of claim 2, wherein an angle formed between the L-shaped projection and the frame side wall is substantially equal to 90 degrees.

* * * * *